US005551915A

United States Patent [19]

Schweikert

[11] Patent Number: 5,551,915

[45] Date of Patent: Sep. 3, 1996

[54] FLOOR MOUNTED AIR DISTRIBUTION OUTLET

[75] Inventor: Wolfgang Schweikert, Stolberg, Germany

[73] Assignee: H. Krantz-TKT GmbH, Gladbach, Germany

[21] Appl. No.: 409,005

[22] Filed: Mar. 23, 1995

[30] Foreign Application Priority Data

Apr. 28, 1994 [DE] Germany ..... 9407055 U

[51] Int. Cl.[6] ..... F24F 13/06

[52] U.S. Cl. ..... 454/290; 454/308

[58] Field of Search ..... 454/284, 289, 454/290, 296, 298, 308, 323

[56] References Cited

FOREIGN PATENT DOCUMENTS 2340781 3/1975 Germany ..... 454/323

3417002 11/1985 Germany ..... 454/289

136644 5/1990 Japan ..... 454/289

*Primary Examiner*—Harold Joyce

*Attorney, Agent, or Firm*—Mark T. Basseches

[57] ABSTRACT

A floor well air distribution outlet for forming a trumpet shaped air stream includes a cylindrical casing the open upper end of which is covered by a distribution disk having radially extending slots. A plate spaced below and parallel to said disk includes an inflow opening concentric with the disk. The radial outermost extremities of the slots are defined by soffits sloping downwardly toward the axis of the disk. A first series of soffits is inclined at a steeper angle than the soffits of a second series intervening between the first series. A cover plate includes radially extending tongues partially overlying the slots, the radial extent of the tongues being such as to overlie the innermost radial extremity of the slots of the second series only. A valve is vertically shiftable between two positions respectively unblocking or blocking the inflow opening.

6 Claims, 2 Drawing Sheets

FLOOR MOUNTED AIR DISTRIBUTION OUTLET

The invention concerns a floor well air distribution outlet having a cylindrical casing with a coaxially arranged inflow opening on the bottom side and a distribution disk arranged concentrically to it on the top side. The disk is provided with uniformly distributed outflow slots which are radially aligned and provides a trumpet shaped flow stream.

PRIOR ART

A floor well outlet, known from DE 39 28 621 A1, includes a casing consisting of a cylindrical socket with a concentric insert. The socket is provided with a collar which radially expands outward in the form of an arc and which changes over into a flange resting on a edge of an opening in the floor. The insert which tapers from top to bottom in the shape of a funnel, forms, in the plane of the flange connected to the socket, a ring disk in which provision has been made for radially aligned outflow slots in a uniform distribution. The outflow slots uniformly are given an outside radial boundary by the collar of the socket which expands in the form of an arc.

The above-described embodiment of the known floor well outlet has the effect, as a result of the uniform curved outside radial boundary of the outflow slots, that the air supply blown into the room flows across the floor in an extremely flat manner and at a relatively high speed. If the curved radial boundary of the outflow slots is replaced by a boundary which is essentially vertically oriented, the air supply is blown into the room vertically.

SUMMARY OF THE INVENTION

The present invention addresses the task of providing a floor well outlet which makes it possible to introduce the air supply into the room with a trumpet shaped flow pattern in the form of a gusher.

Briefly, the desired result is achieved by providing a cylindrical casing with a cover disk having radially directed slots. Each slot has a radial outermost end defined by a soffit sloping downwardly toward the disk axis.

The soffits of a first series of slots are inclined at a steeper angle than the soffits of a second series of slots intervening between the first series. A cover plate includes radially extending tongues partly covering the slots, the tongues overlying the innermost extremities of the less inclined soffits but not the steeper soffits. A valve plate may be shifted from blocking to unblocking positions of an inlet opening formed in a plate below and spaced from the disk.

As a result of the differential formation, in accordance with this invention, of the narrow side slot soffits, which are alternatingly defined by an inclined plane with a smaller degree of inclination and by an inclined plane with a larger degree of inclination, the air supply does not emerge in two divergent groups of individual streams which, with increasing distance from the well outlet, also move away from each other. Rather, the adjoining air supply streams influence each other in a particularly advantageous manner, by causing the flows of the two groups to combine intensively with each other and by producing the desired trumpet shaped flow pattern.

According to one embodiment of the invention, narrow side slot soffits which are radially located on the inside are overlaid in each case by a tongue which narrows the cross section of the slot outflow.

As a result of this construction, there is produced for all outflow slots in the plane of their outflow cross section an angular redirection of the flow, which results in a widening of the air supply stream as a whole.

In the case of the outflow slots the narrow side slot soffit of which possesses the smallest degree of inclination, the cross section of the slot inflow concerned preferably is completely overlaid by the tongue.

By means of this construction the differential effect of the neighboring outflow slots is further strengthened, by the tips of the tongues alternatingly covering one inflow cross section completely and a following inflow cross section only partially.

According to a further embodiment of the invention, the narrow side slot soffits which lie radially on the inside are arranged on a larger diameter than the diameter of the inflow opening of the casing, with the latter being capable of being closed by a closing disk which is positioned in the casing in a manner that permits its adjustment in terms of height.

As a result of this construction the outflow slots remain unaffected by the closing disk regardless of its position.

In order to be able, as desired, to close and open the inflow opening of the well outlet by means of a handle, an embodiment of the invention finally also provides that the closing disk can be shifted into the lower closing position against the effect of a compression spring with the aid of a pin introduced through a central bore into a cover of the casing, and can be latched or unlatched by a grid locking mechanism which is known per se and can be shifted into the upper opening position through the effect of the compression spring.

BRIEF DESCRIPTION OF DRAWINGS

The drawing shows an example of the embodiment of a floor well outlet in accordance with the invention.

DETAILED DESCRIPTION OF DRAWINGS

Essentially, the floor well outlet comprises a cylindrical casing 1 which can be inserted into an opening in a floor 2 below which there is located a hollow space or duct which supplies additional air. In a floor plate 3 of the casing 1 there is concentrically provided an inflow opening 4 through which the floor well outlet above the hollow space is supplied with additional air.

Figure 2:
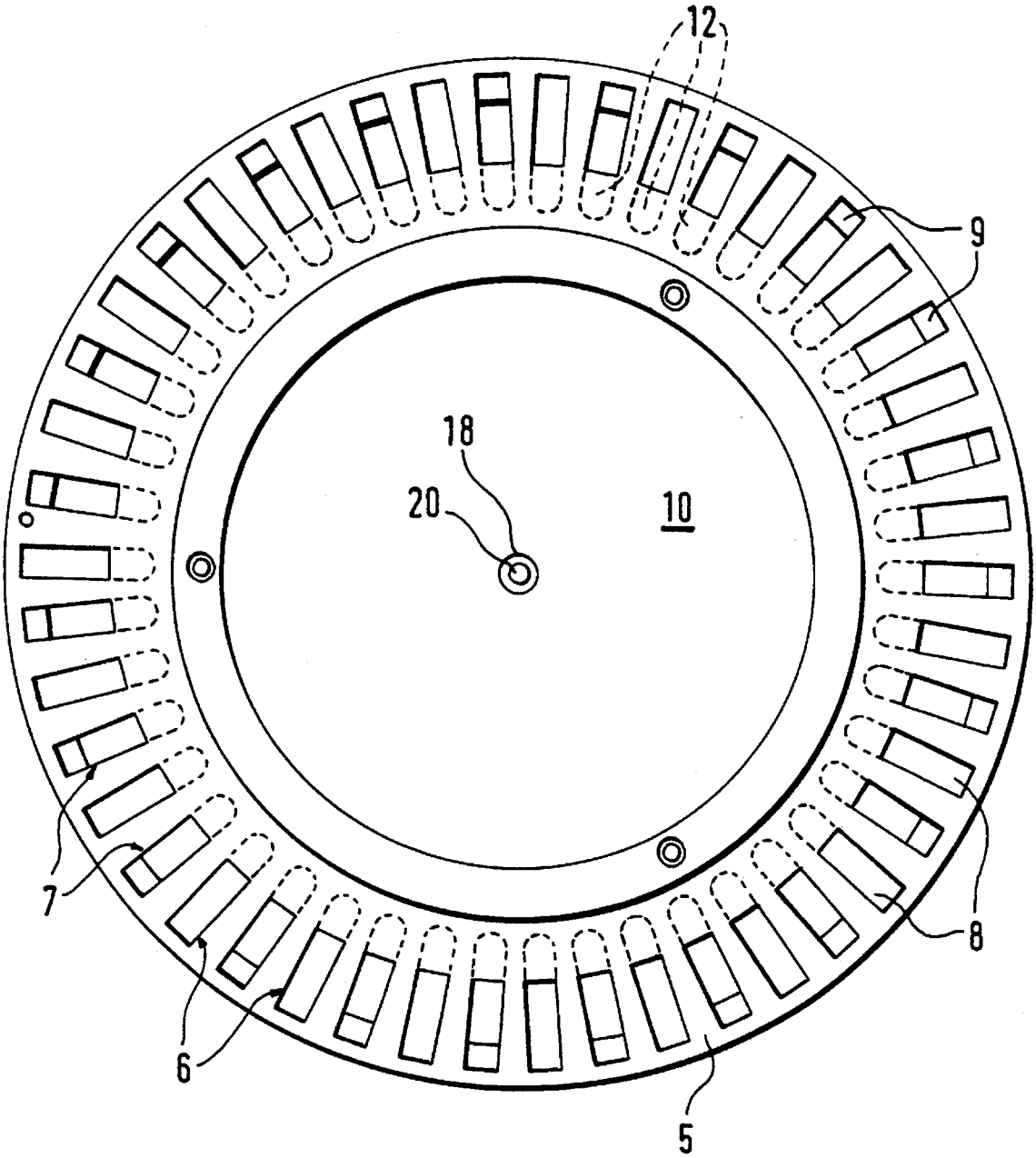
FIG. 2 shows a horizontal plan view of the outlet.

As is made clear particularly by FIG. 2, the casing 1 on the top side is provided with a ring disk 5 in which provision has been made for radially aligned outflow slots 6 and 7. An outflow slot 6 is alternatingly followed by an outflow slot 7.

Figure 1:
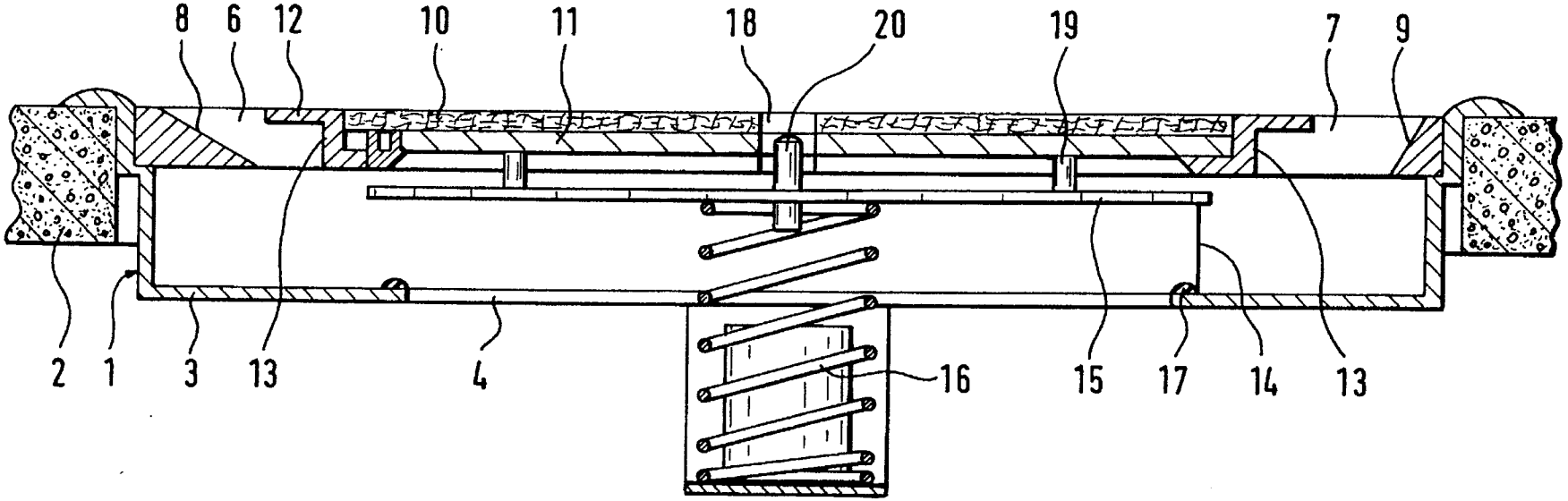
FIG. 1 shows a vertical cross section through the outlet.

As can be seen from the cross sectional representation in FIG. 1, the outflow slots 6 and 7 are provided with narrow side slot soffits 8 and 9, respectively, at their radial outermost ends. In each case, the soffits are defined by an inclined plane with a different degree of inclination, with the slot soffit 8 possessing a smaller degree of inclination than slot soffit 9.

Within ring disk 5 there is inserted a circular cover plate 11 which is covered by carpeting material 10 or the like, and which, with a radially outwardly protruding collar, forms tongues 12 in the area in registry with the outflow slots 6 and 7. These tongues in each case overlay a narrow side inner slot soffit 13, radially located inside, of the outflow slots 6 and 7. While the inflow cross section of the outflow slots 6, due to the lesser inclination of the slot soffit 8, is completely overlaid by a tongue 12, the inflow cross section of the outflow slots 7, due to the steeper slot soffit 9, is only partially overlaid.

From the active open position shown, the floor well outlet can be changed in a simple manner into a passive closed position. For that purpose, a closing disk 15 which is guided in casing 1 over vertical bars 14 can be lowered against the action of a compression spring 16 on an elastic ring elevation 17 at the edge of the inflow opening 4 and arrested by a locking rigid mechanism which is known per se. This locking grid mechanism may be formed to function in the same way as it is employed in the case of ball point pens, with the lead of the ball point pen located between two end positions in an axially adjustable manner and, by means of a simple operation of a press button, capable of being fixed in the one or the other position. In the example of the embodiment shown, to the closing disk 15 there is concentrically allocated a corresponding press button 19 which may be operated by a simple pin, now shown here. For that purpose, there is provided in the carpeted floor 10 and in the cover plate 11 a bore 18 which is coaxial with the press button 16 and through which the pin can be introduced for the purpose of operation. Through pressure exerted by the pin on the press button 16 it is possible to shift the lock disk 15, which is supported over three spacer bolts 19 against the underside of the cover plate, into the lower locking position and engaged in it. With the same pin the cover plate 11 is unlocked so that it, due to the pressure of the spring 16, is raised into the open position shown and maintained in it.

As will be apparent from the foregoing, there is disclosed, in accordance with the invention, an improved air flow distribution device capable of introducing a trumpet shaped air stream into a room. The invention is to be broadly construed within the scope of the appended claims, since minor variations, not departing from the spirit of the invention, will readily occur to skilled workers in the art familiarized with the instant disclosure.

Having thus described the invention and illustrated its use, what is claimed as new and is desired to be secured by Letters Patent is:

1. A floor well air distribution outlet for forming a trumpet shaped air stream comprising a cylindrical casing, a ring disk overlying said casing, a plate in spaced parallel relation to said disk, said plate including an inflow opening concentric with said disk, said disk including a first and second series of radially directed slots extending therethrough, the slots of said first series intervening between the slots of said second series, said slots being defined at their radial outermost ends by soffit portions sloping downwardly toward the axis of said disk, the inclination of said soffit portions of said first series being steeper than the inclination of said soffit portions of said second series and a cover member overlying said disc, said cover member including a plurality of radially outwardly extending tongue portions, said tongue portions partially covering said slots.

2. An air distribution outlet in accordance with claim 1 wherein said tongue portions overlie the radial innermost extremities of said soffit portions of said second series and terminate radially inwardly of a vertical projection extending through the radial innermost extremities of the soffits of said first series.

3. An air distribution outlet in accordance with claim 2 wherein the radial innermost extremities of said slots lie on a circle, the diameter of which is larger than the diameter of said inflow opening of said plate.

4. An air distribution outlet in accordance with claim 3 and including a valve member interposed between and parallel to said plate and disk, said valve member being shiftable between sealing and unsealing position of said inflow opening.

5. An air distribution outlet in accordance with claim 4 and including latch means interposed between said valve and casing for selectively supporting said valve in said sealing and unsealing positions.

6. An air distribution outlet in accordance with claim 5 wherein said latch means is accessible through said disk.

* * * * *